US005341643A

United States Patent [19]

Hamburg et al.

[11] Patent Number: 5,341,643

[45] Date of Patent: Aug. 30, 1994

[54] FEEDBACK CONTROL SYSTEM

[75] Inventors: Douglas R. Hamburg, Bloomfield; Eleftherios M. Logothetis, Birmingham; Richard E. Soltis, Redford; Jacobus H. Visser, Belleville, all of Mich.

[73] Assignee: Ford Motor Company, Dearborn, Mich.

[21] Appl. No.: 43,095

[22] Filed: Apr. 5, 1993

[51] Int. Cl.[5] ..... F01N 3/28

[52] U.S. Cl. ..... 60/276; 60/277; 60/285; 123/691

[58] Field of Search ..... 60/274, 276, 277, 285; 123/691, 688

[56] References Cited

U.S. PATENT DOCUMENTS

| | | | |
|---|---|---|---|
| 4,194,471 | 3/1980 | Baresel . | |
| 4,789,939 | 12/1988 | Hamburg . | |
| 4,878,473 | 11/1989 | Nakaniwa et al. . | |
| 4,915,080 | 4/1990 | Nakaniwa et al. . | |
| 4,988,428 | 1/1991 | Iwakiri et al. . | |
| 5,259,189 | 11/1993 | Baier | 123/691 |

FOREIGN PATENT DOCUMENTS

| | | | |
|---|---|---|---|
| 125941 | 5/1990 | Japan | 123/691 |

OTHER PUBLICATIONS

Article entitled "$NO_2$ Gas-Concentration Measurement with a Saw-Chemosensor", IEEE Transactions on Ultrasonics, Ferroelectrics, and Frequency Control, vol. UFFC-34, No. 2, Mar. 1987, pp. 148-155; by Adrian Venema et al.

*Primary Examiner*—Douglas Hart

*Attorney, Agent, or Firm*—Allan J. Lippa; Roger L. May

[57] ABSTRACT

An air/fuel control system which includes feedback control from an exhaust gas oxygen sensor positioned upstream of a catalytic converter. The exact air/fuel ratio required optimum converter efficiency is determined by generating an emissions signal from both a HC/CO sensor and a NO sensor each positioned downstream of the catalytic converter. The feedback variable is trimmed by a signal derived from the emissions signal to maintain air/fuel operation at a value corresponding to maximum converter efficiency.

8 Claims, 5 Drawing Sheets

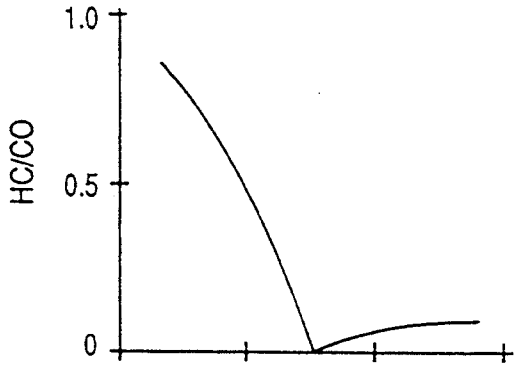
FIG.3A
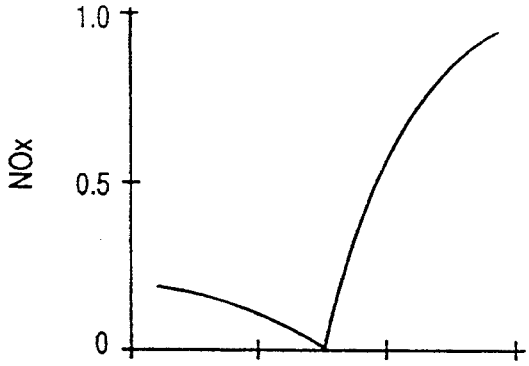
FIG.3B
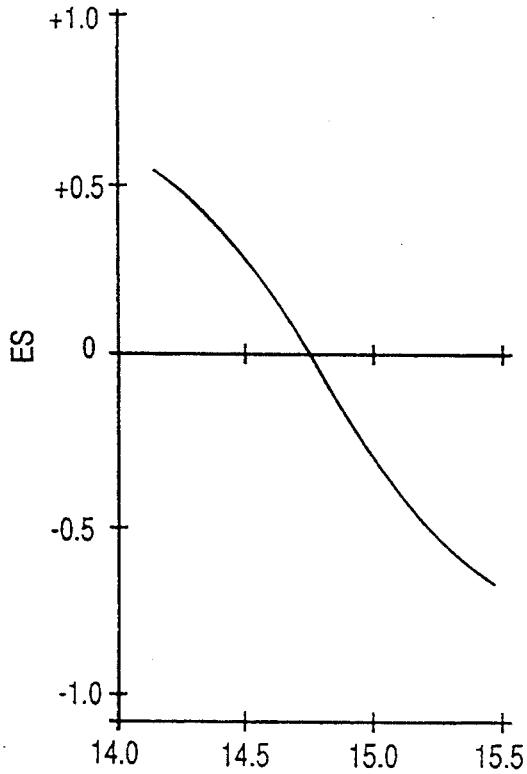
FIG.3C
FIG.3D

FEEDBACK CONTROL SYSTEM

BACKGROUND OF THE INVENTION

The field of the invention relates to air/fuel control systems for internal combustion engines equipped with catalytic converters.

Feedback control systems are known for trimming liquid fuel delivered to an internal combustion engine in response to an exhaust gas oxygen sensor positioned upstream of a three-way catalytic converter. Typically, the exhaust gas oxygen sensor provides a two-state, high/low (rich/lean) output dependent upon the existence of a low or high oxygen partial pressure in the engine exhaust under local thermodynamic equilibrium on the sensor electrodes. Because the exhaust gas may not be in thermodynamic equilibrium, the high-to-low switch point of the sensor may not occur at the stoichiometric air/fuel ratio. In particular, the switch point may not coincide exactly with the peak of the window of the three-way catalytic converter. It is also known to use a second EGO sensor downstream of the catalytic converter for the purpose of reducing the mismatch between the sensor switch point and the peak window of the catalytic converter by biasing the mean air/fuel value.

The inventors herein have recognized, however, that even though an exhaust gas oxygen sensor positioned downstream of a catalytic converter provides a better indication of the catalytic converter operating window than an upstream sensor, it may not always provide the desired indication. Even when a relatively good correspondence is initially achieved, aging and temperature affects of the downstream oxygen sensor may cause a variance between the sensor indication and the air/fuel ratio required for maximum efficiency of the catalytic converter. The inventors herein have also found that even when the post catalytic oxygen sensor accurately switches at stoichiometry, the switch point may not be accurately aligned with the most efficient converter efficiency for a particular converter.

SUMMARY OF THE INVENTION

An object of the invention herein is to provide engine air/fuel operation within the operating window of the any catalytic converter coupled to the engine exhaust regardless of the air/fuel location of the converter's operating window. The above object is achieved, and disadvantages of prior approaches overcome, by providing both a control system and method for optimizing conversion efficiency of a catalytic converter positioned in the engine exhaust. In one particular aspect of the invention, the control method comprises the steps of: measuring nitrogen oxide content of exhaust gases downstream of the catalytic converter to generate a first measurement signal, measuring combined hydrocarbon and carbon monoxide content in exhaust gases downstream of the catalytic converter to generate a second measurement signal, subtracting the first measurement signal from the second measurement signal to generate a third signal, generating a correction signal from an exhaust gas oxygen sensor positioned upstream of the catalytic converter, trimming the correction signal with a trim signal derived from the third signal and then integrating to generate a feedback variable, and correcting fuel delivered to the engine by the feedback variable to maintain maximum conversion efficiency of the catalytic converter.

An advantage of the above aspect of the invention is that engine air/fuel operation is achieved at an air/fuel ratio which results in maximum catalytic converter efficiency regardless of the converter used. This advantage is obtained while maintaining rapid air/fuel corrections.

BRIEF DESCRIPTION OF THE DRAWINGS

The object and advantages of the invention described above and others will be more clearly understood by reading an example of an embodiment in which the invention is used to advantage with reference to the attached drawings wherein:

FIGS. 3A–3D represent various electrical waveforms generated by a portion of the embodiment shown in FIG. 1 and further described in FIG. 2;

DESCRIPTION OF AN EMBODIMENT

Figure 1:
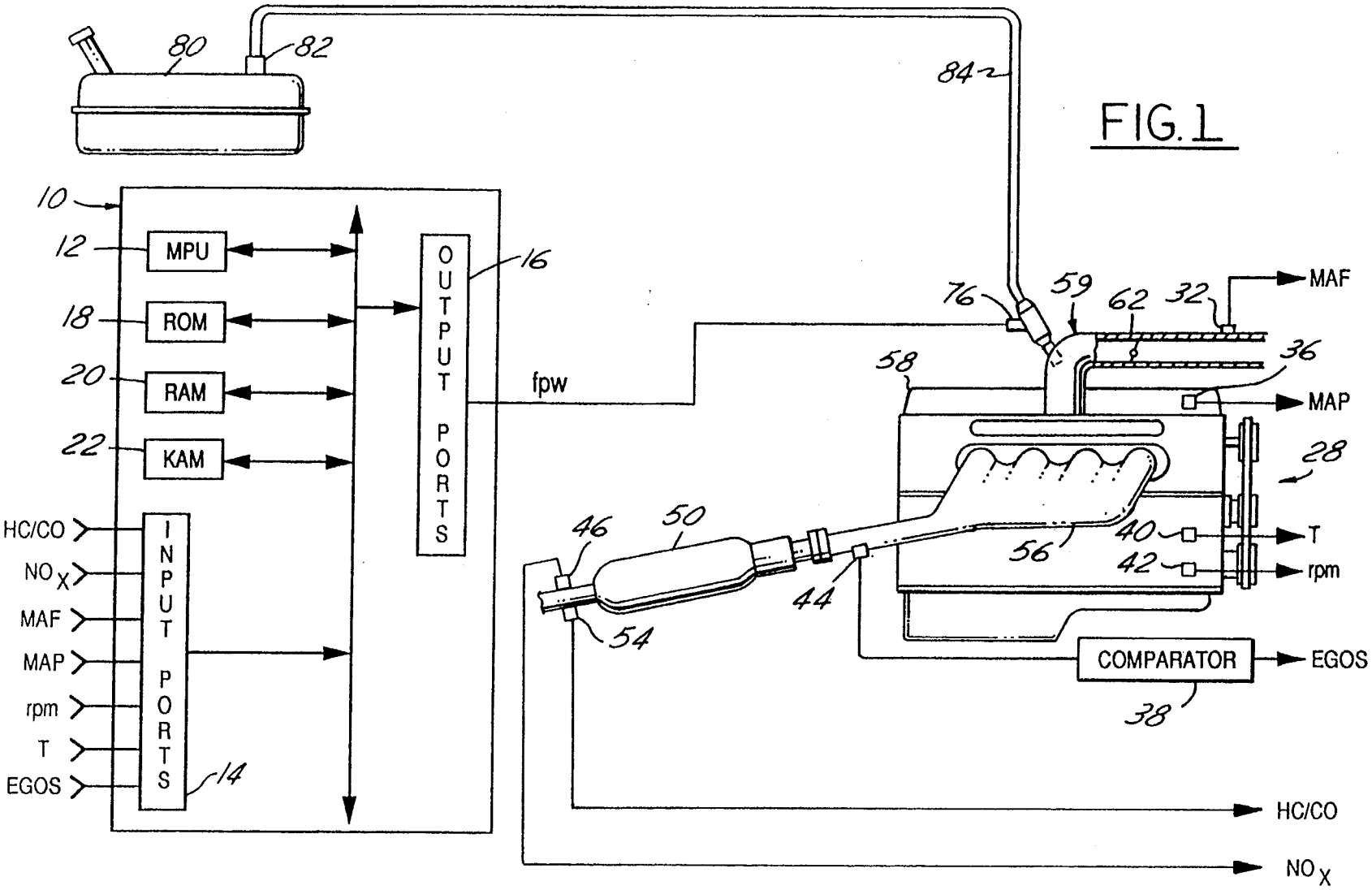
FIG. 1 is a block diagram of an embodiment wherein the invention is used to advantage.

Controller 10 is shown in the block diagram of FIG. 1 as a conventional microcomputer including: microprocessor unit 12; input ports 14; output ports 16; read-only memory 18, for storing the control program; random access memory 20 for temporary data storage which may also be used for counters or timers; keep-alive memory 22, for storing learned values; and a conventional data bus.

Controller 10 is shown receiving various signals from sensors coupled to engine 28 including; measurement of inducted mass airflow (MAF) from mass airflow sensor 32; manifold pressure (MAP), commonly used as an indication of engine load, from pressure sensor 36; engine coolant temperature (T) from temperature sensor 40; indication of engine speed (rpm) from tachometer 42; indication of nitrogen oxides (NOx) in the engine exhaust from nitrogen oxide sensor 46 positioned downstream of three-way catalytic converter 50; and a combined indication of both HC and CO from sensor 54 positioned in the engine exhaust downstream of catalytic converter 50. In this particular example, sensor 54 is a catalytic-type sensor sold by Sonoxco Inc. of Mountain View, Calif. and sensor 46 is a nitrogen dioxide Saw-Chemosensor as described in IEEE Transactions on Ultrasonics, Ferroelectrics, and Frequency Control, VOL. UFFC-34, NO. 2, Mar. 19, 1987, pgs. 148–155. The invention may also be used to advantage with separate measurements of HC and CO by separate hydrocarbon and carbon monoxide sensors.

In addition, controller 10 receives two-state (rich/lean) signal EGOS from comparator 38 resulting from a comparison of exhaust gas oxygen sensor 44, positioned upstream of catalytic converter 50, to a reference value. In this particular example, signal EGOS is a positive predetermined voltage such as one volt when the output of exhaust gas oxygen sensor 44 is greater than the reference value and a predetermined negative voltage when the output of sensor 44 switches to a value less than the reference value. Under ideal conditions, with an ideal sensor and exhaust gases fully equilibrated, signal EGOS will switch states at a value corresponding to stoichiometric combustion.

Intake manifold 58 of engine 28 is shown coupled to throttle body 59 having primary throttle plate 62 positioned therein. Throttle body 59 is also shown having fuel injector 76 coupled thereto for delivering liquid fuel in proportion to the pulse width of signal fpw from controller 10. Fuel is delivered to fuel injector 76 by a conventional fuel system including fuel tank 80, fuel pump 82, and fuel rail 84.

Figure 2:
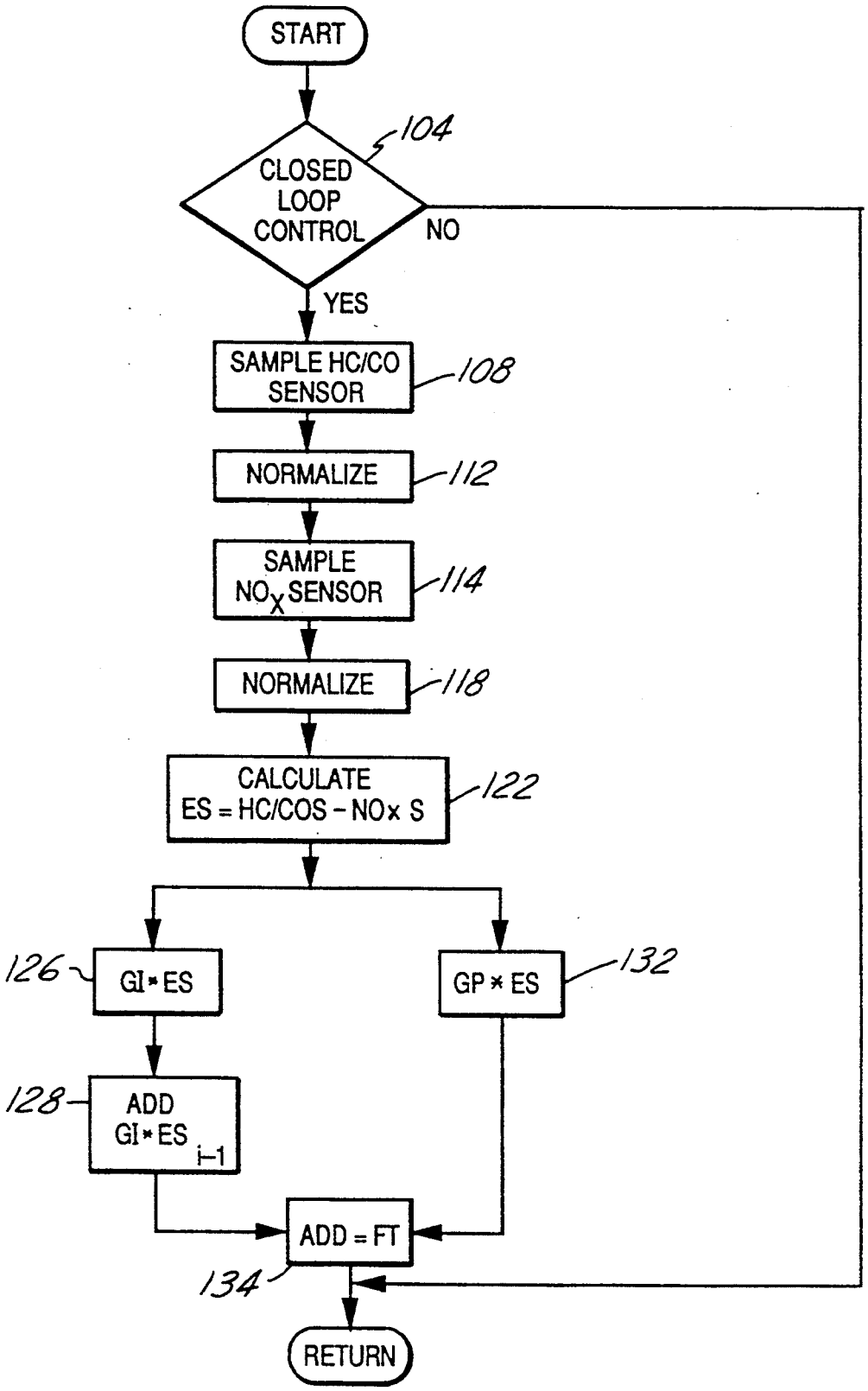
FIG. 2 is a high level flowchart of various operations performed by a portion of the embodiment shown in FIG. 1.

Referring now to FIG. 2, a flowchart of a routine performed by controller 10 to generate fuel trim signal FT is now described. A determination is first made whether closed-loop air/fuel control is to be commenced (step 104) by monitoring engine operating conditions such as temperature. When closed-loop control commences, sensor 54 is sampled (step 108) which, in this particular example, provides an output signal related to the quantity of both HC and CO in the engine exhaust.

The HC/CO output of sensor 54 is normalized with respect to engine speed and load during step 112. A graphical representation of this normalized output is presented in FIG. 3A. As described in greater detail later herein, the zero level of the normalized HC/CO output signal is correlated with the operating window, or point of maximum converter efficiency, of catalytic converter 50.

Continuing with FIG. 2, nitrogen oxide sensor 46 is sampled during step 114 and normalized with respect to engine speed and load during step 118. A graphical representation of the normalized output of nitrogen oxide sensor 46 is presented in FIG. 3B. The zero level of the normalized nitrogen oxide signal is correlated with the operating window of catalytic converter 50 resulting in maximum converter efficiency.

During step 122, the normalized output of nitrogen oxide sensor 46 is subtracted from the normalized output of HC/CO sensor 54 to generate combined emissions signal ES. The zero crossing point of emission signal ES (see FIG. 3D) corresponds to the actual operating window for maximum converter efficiency of catalytic converter 50. As described below with reference to process steps 126 to 134, emission signal ES is processed in a proportional plus integral controller to generate fuel trim signal FT for trimming feedback variable FV which is generated as described later herein with respect to the flowchart shown in FIG. 4.

Referring first to step 126, emission signal ES is multiplied by gain constant GI and the resulting product added to the products previously accumulated ($GI*ES_{i-1}$) in step 128. Stated another way, emission signal ES is integrated each sample period (i) in steps determined by gain constant GI. During step 132, emission signal ES is also multiplied by proportional gain GP. The integral value from step 128 is added to the proportional value from step 132 during addition step 134 to generate fuel trim signal FT. In summary, the proportional plus integral control described in steps 126–132 generates fuel trim signal FT from emission signal ES.

Figure 4:
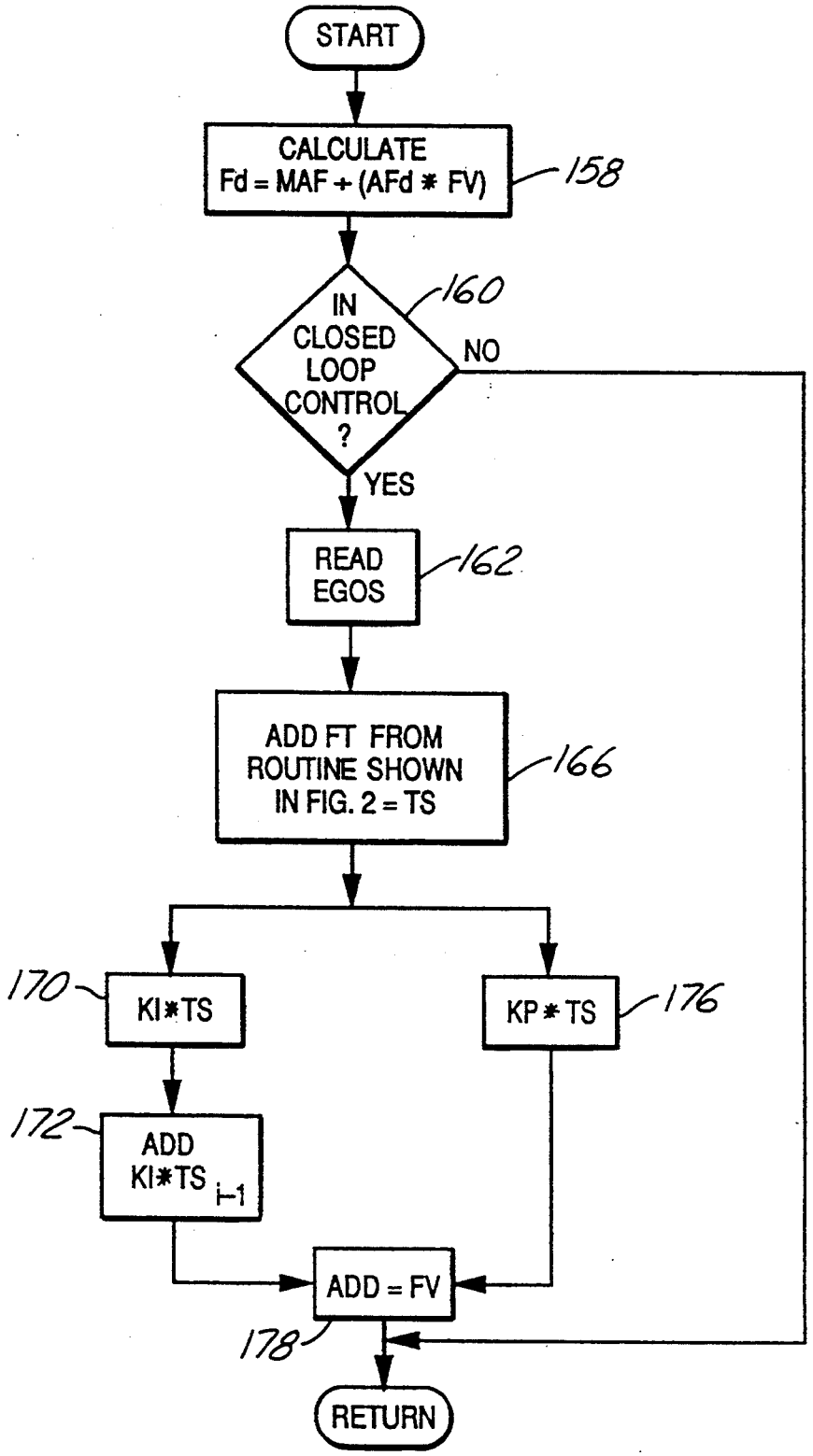
FIG. 4 is a high level flowchart of various operations performed by a portion of the embodiment shown in FIG. 1.

The routine executed by microcomputer 10 to generate the desired quantity of liquid fuel delivered to engine 28 and trimming this desired fuel quantity by a feedback variable related both to EGO sensor 44 and fuel trim signal FT is now described with reference to FIG. 4. During step 158, an open-loop fuel quantity is first determined by dividing measurement of inducted mass airflow (MAF) by desired air/fuel ratio AFd which is typically the stoichiometric value for gasoline combustion. This open-loop fuel charge is then trimmed, in this example divided, by feedback variable FV.

After a determination that closed-loop control is desired (step 160) by monitoring engine operating conditions such as temperature, signal EGOS is read during step 162. During step 166, fuel trim signal FT is transferred from the routine previously described with reference to FIG. 2 and added to signal EGOS to generate trim signal TS.

During steps 170–178, a conventional proportional plus integral feedback routine is executed with trimmed signal TS as the input. Trimmed signal TS is first multiplied by integral gain value KI (see step 170) and this product is added to the previously accumulated products (see step 172). That is, trimmed signal TS is integrated in steps determined by gain constant KI each sample period (i). This integral value is added to the product of proportional gain KP times trimmed signal TS (see step 176) to generate feedback variable FV (see step 178). As previously described with reference to step 158, feedback variable FV trims the fuel delivered to engine 28. Feedback variable FV will correct the fuel delivered to engine 28 in a manner to drive emission signal ES to zero.

Figure 5:
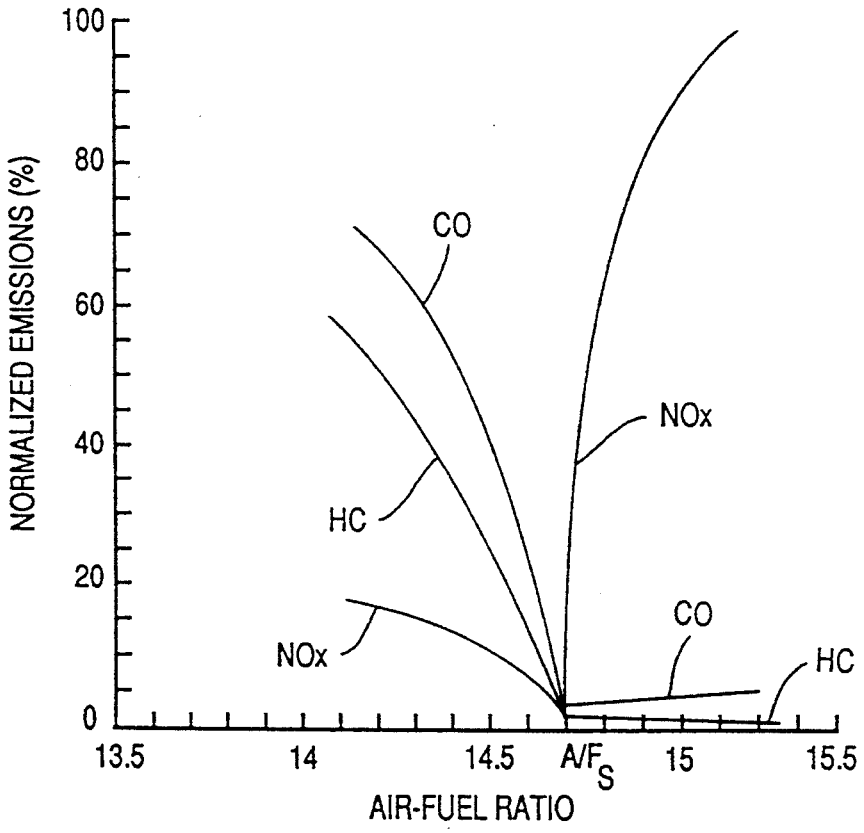
FIG. 5 is graphical representation of normalized emissions passing through a catalytic converter as a function of engine air/fuel operation.

An example of operation for the above described air/fuel control system is shown graphically in FIG. 5. More specifically, measurements of HC, CO, and NOx emissions from catalytic converter 50 after being normalized over an engine speed load range are plotted as a function of air/fuel ratio. Maximum converter efficiency is shown when the air/fuel ratio is increasing in a lean direction, at the point when CO and HC emissions have fallen near zero, but before NOx emissions have begun to rise. Similarly, while the air/fuel ratio is decreasing, maximum converter efficiency is achieved when nitrogen oxide emissions have fallen near zero, but CO and HC emissions have not yet begun to rise.

In accordance with the above described operating system, the operating window of catalytic converter 50 will be maintained at the zero crossing point of emissions signal ES (see FIG. 3D) regardless of the reference air/fuel ratio selected and regardless of the switch point of EGO sensor 44.

An example of operation has been presented wherein emission signal ES is generated by subtracting the output of a nitrogen oxide sensor from a combined HC/CO sensor and thereafter fed into a proportional plus integral controller. The invention claimed herein, however, may be used to advantage with other than a proportional plus integral controller. The invention claimed herein may also be used to advantage with separate HC and CO sensors or the use of either a CO or a HC sensor in conjunction with a nitrogen oxide sensor. And, the invention may be used to advantage by combining the sensor outputs by signal processing means other than simple subtraction. Accordingly, the inventors herein intend that the invention be defined only by the following claims.

What is claimed:

1. An engine air/fuel control method for optimizing conversion efficiency of a catalytic converter positioned in the engine exhaust, comprising the steps of:

measuring nitrogen oxide content of exhaust gases downstream of the catalytic converter to generate a first measurement signal;

measuring combined hydrocarbon and carbon monoxide content in exhaust gases downstream of the catalytic converter to generate a second measurement signal;

subtracting said first measurement signal from said second measurement signal to generate a third signal;

generating a correction signal from an exhaust gas oxygen sensor positioned upstream of the catalytic converter;

trimming said correction signal with a trim signal derived from said third signal and then integrating to generate a feedback variable; and correcting fuel delivered to the engine by said feedback variable to maintain maximum conversion efficiency of the catalytic converter.

2. The engine air/fuel control method recited in claim 1 further comprising the step of integrating said third signal to derive said trim signal.

3. The engine air/fuel control method recited in claim 2 further comprising the step of multiplying said third signal by a proportional term and adding the resulting product to said integration of said third signal to derive said trim signal.

4. An engine air/fuel control method for optimizing conversion efficiency of a catalytic converter positioned in the engine exhaust, comprising the steps of:

measuring nitrogen oxide content of exhaust gases downstream of the catalytic converter and normalizing said measurement with respect to at least engine speed to generate a first measurement signal;

measuring combined hydrocarbon and carbon monoxide content in exhaust gases downstream of the catalytic converter and normalizing said measurement with respect to at least engine speed to generate a second measurement signal;

subtracting said first measurement signal from said second measurement signal to generate a trim signal;

generating a correction signal from an exhaust gas oxygen sensor positioned upstream of the catalytic converter;

trimming said correction signal with said trim signal and then integrating to generate a feedback variable;

delivering fuel to the engine in response to an indication of airflow inducted into the engine and a reference air/fuel ratio; and correcting said delivered fuel by said feedback variable to maintain maximum conversion efficiency of the catalytic converter.

5. The engine air/fuel control method recited in claim 4 wherein said trim signal is derived by integrating said emissions indicating signal and adding a product of a gain value times said emissions indicating signal to the resulting integration.

6. The engine air/fuel control method recited in claim 4 wherein said step of generating a correction signal further comprises a step of comparing said exhaust gas oxygen sensor output to a reference value such that said correction signal has a predetermined amplitude with a first polarity when exhaust gases are rich of a preselected air/fuel ratio and a second polarity opposite said first polarity when said exhaust gases are lean of said preselected air/fuel ratio.

7. An engine control system for optimizing conversion efficiency of a catalytic converter positioned in the engine exhaust, comprising:

a first sensor positioned downstream of the catalytic converter for providing a first electrical signal having an amplitude related to quantity of nitrogen oxides in the exhaust;

a second sensor positioned downstream of the catalytic converter for providing a second electrical signal having an amplitude related to quantity of at least one exhaust by-product other than nitrogen oxides, said second electrical signal is related to quantity of carbon monoxide in the engine exhaust;

an exhaust gas oxygen sensor positioned upstream of the catalytic converter for providing a feedback signal related to oxygen content of the exhaust gases;

correction means for combining said first and said second electrical signals to generate a trim signal related to maximum converter efficiency of the catalytic converter and for correcting said feedback signal with said trim signal; and fuel control means for delivering fuel to the engine in relation to quantity of air inducted into the engine and a desired air/fuel ratio and said corrected feedback variable.

8. An engine control system for optimizing conversion efficiency of a catalytic converter positioned in the engine exhaust, comprising:

a first sensor positioned downstream of the catalytic converter for providing a first electrical signal having an amplitude related to quantity of nitrogen oxides in the exhaust;

a second sensor positioned downstream of the catalytic converter for providing a second electrical signal having an amplitude related to quantity of at least one exhaust by-product other than nitrogen oxides, said second electrical signal is related to quantity of hydrocarbons in the engine exhaust;

an exhaust gas oxygen sensor positioned upstream of the catalytic converter for providing a feedback signal related to oxygen content of the exhaust gases;

correction means for combining said first and said second electrical signals to generate a trim signal related to maximum converter efficiency of the catalytic converter and for correcting said feedback signal with said trim signal; and fuel control means for delivering fuel to the engine in relation to quantity of air inducted into the engine and a desired air/fuel ratio and said corrected feedback variable.

* * * * *